US012404474B1

(12) United States Patent
Dugger et al.

(10) Patent No.: US 12,404,474 B1
(45) Date of Patent: Sep. 2, 2025

(54) ENVIRONMENTALLY STABLE SOLID LUBRICANT COATING

(71) Applicant: National Technology & Engineering Solutions of Sandia, LLC, Albuquerque, NM (US)

(72) Inventors: Michael T. Dugger, Tijeras, NM (US); Steven Robert Larson, Albuquerque, NM (US); Alexander James Mings, Albuquerque, NM (US); John Francis Curry, Albuquerque, NM (US); Tomas Farley Babuska, Albuquerque, NM (US); Michael E. Chandross, Tijeras, NM (US); Nathaniel S. Bobbitt, Albuquerque, NM (US); Ping Lu, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 18/767,130

(22) Filed: Jul. 9, 2024

Related U.S. Application Data

(60) Provisional application No. 63/525,772, filed on Jul. 10, 2023.

(51) Int. Cl.

| | |
|---|---|
| ***C10M 103/06*** | (2006.01) |
| ***C10N 10/12*** | (2006.01) |
| ***C10N 20/00*** | (2006.01) |
| ***C10N 50/00*** | (2006.01) |

(52) U.S. Cl.
CPC .... *C10M 103/06* (2013.01); *C10M 2201/066* (2013.01); *C10N 2010/12* (2013.01); *C10N 2020/055* (2020.05); *C10N 2050/023* (2020.05)

(58) Field of Classification Search
CPC ..... C10M 103/06; C10M 2201/066; C10N 2010/12; C10N 2010/055; C10N 2050/023
See application file for complete search history.

(56) References Cited

U.S. PATENT DOCUMENTS 5,002,798 A * 3/1991 Donley ..... C10M 103/06 427/255.31
5,282,985 A * 2/1994 Zabinski ..... C10M 125/04 508/156
2019/0362971 A1* 11/2019 Wong ..... C01B 19/007

OTHER PUBLICATIONS

Curry, J. F. et al., "Highly Oriented MoS2 Coatings: Tribology and Environmental Stability," 2016, Tribology Letters, vol. 64, 11.
Curry, J. F. et al., "Impact of Microstructure on MoS2 Oxidation and Friction," ACS Appl. Mater. Interfaces, 2017, vol. 9, 28019-28026.
(Continued)

*Primary Examiner* — James C Goloboy
(74) *Attorney, Agent, or Firm* — Kevin W. Bieg

(57) ABSTRACT

The invention is directed to environmentally stable solid lubricant coatings with bilayer transition-metal dichalcogenide structures that are designed to resist the effects of oxidation during long term storage, or during short exposures under conditions that would oxidize similar films that do not have these bilayer structures. In addition to improving oxidation resistance, these bilayer structures also facilitate the more rapid establishment of a low, steady-state friction coefficient than is possible with similar films that do not have these bilayer structures.

10 Claims, 7 Drawing Sheets

(56) References Cited

OTHER PUBLICATIONS

Curry, J. F. et al., "Structurally Driven Environmental Degradation of Friction in MoS2 Films," Tribology Letters, 2021, vol. 69, 96.
Moser, J. et al., "Texture characterisation of sputtered MoS2 thin films by cross-sectional TEM analysis," Journal of Physics D: Applied Physics, 1990, vol. 23, pp. 624-626.
Scharf, T. W. Scharf et al., "Friction and wear mechanisms in MoS2/Sb2O3/Au nanocomposite coatings," Acta Matererialia, 2010, vol. 58, pp. 4100-5109.
Vaziriseresh k, M. R. Vaziriseresh k et al., "Solid Lubrication with MoS2: A Review," Lubricants, 2019, vol. 7, 57.

* cited by examiner

ENVIRONMENTALLY STABLE SOLID LUBRICANT COATING

CROSS-REFERENCE TO RELATED APPLICATION

This application claims the benefit of U.S. Provisional Application No. 63/525,772, filed Jul. 10, 2023, which is incorporated herein by reference.

FEDERALLY SPONSORED RESEARCH AND DEVELOPMENT

This invention was made with Government support under Contract No. DE-NA0003525 awarded by the United States Department of Energy/National Nuclear Security Administration. The Government has certain rights in the invention.

BACKGROUND OF THE INVENTION

Thin films (on the order of 1 micrometer thick) of transition-metal dichalcogenides (TMDs) are commonly used as solid lubricants, with $MoS_2$ as the most common example of this family of materials. These films provide lubrication over a wide operating temperature range, are low outgassing, and do not migrate. They are therefore used in satellite and other precision aerospace applications that require these performance characteristics. Despite their excellent friction performance (friction coefficient approximately 0.05 in dry inert or vacuum atmospheres), they are subject to surface oxidation during exposure to air, or to low concentrations of reactive species over long duration, that can increase the initial friction coefficient by an order of magnitude. This elevated initial friction coefficient, referred to as "run-in," persists until the oxidized material is worn through.

SUMMARY OF THE INVENTION

The present invention is directed to a method for synthesizing environmentally stable solid lubricant coatings, comprising depositing an amorphous layer of a transition-metal dichalcogenide on a substrate; and then depositing a crystalline layer of the transition-metal dichalcogenide on top of the amorphous layer. For example, the crystalline layer can comprise randomly oriented crystallites or a basally-oriented crystalline layer.

The invention can further comprise an environmentally stable solid lubricant coating having oxidation and run-in resistance, comprising an amorphous layer of a transition-metal dichalcogenide on a substrate and a crystalline layer of the transition-metal dichalcogenide on top of the amorphous layer.

BRIEF DESCRIPTION OF THE DRAWINGS

The detailed description will refer to the following drawings, wherein like elements are referred to by like numbers.

FIG. 1A is a view along the basal planes. FIG. 1B is a view down the c-axis.

DETAILED DESCRIPTION OF THE INVENTION

Figure 1B:
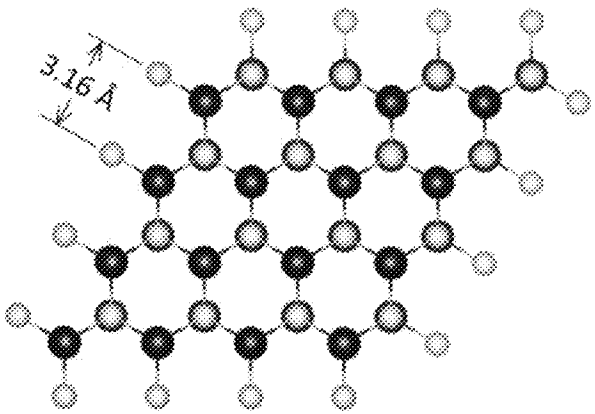
FIGS. 1A and 1B illustrate the $MoS_2$ hexagonal polytype, in which $MoS_2$ crystallites are oriented parallel to the substrate.
Figure 1A:
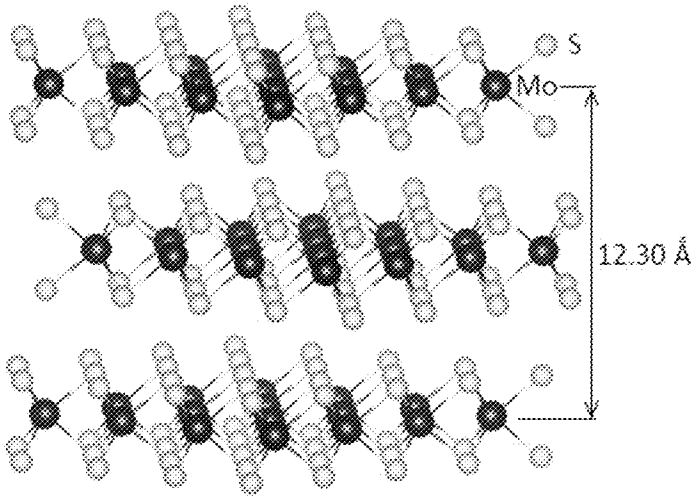

Transition-metal dichalcogenides (TMDs) comprise a transition metal, such as molybdenum, tungsten, tantalum, or niobium, and two chalcogens, such as sulfur, selenium, or tellurium. Their three-atom thick unit cell is formed by a layer of transition metal atoms (Mo, W, Ta, or Nb) sandwiched between two layers of chalcogen atoms (S, Se, or Te). For example, molybdenum disulfide ($MoS_2$) belongs to the family of layered two-dimensional transition-metal dichalcogenides. $MoS_2$ is a lamellar solid material that consists of covalently bonded sheets, or lamellae, which form stacks that are held together by weak van der Waals interactions. $MoS_2$ can have several different crystalline structures, depending on the bonding within the sheets and between the stacks of lamellae sheets. FIGS. 1A and 1B illustrate the common semiconducting hexagonal polytype, in which $MoS_2$ crystallites are oriented with their c axis perpendicular to the substrate with ABA stacking when viewed along the basal plane. The low shear strength and subsequently low friction coefficients of $MoS_2$ are a result of this lamellar structure, where the basally oriented, molecularly thin lamellae with sulfur-terminated basal planes interact predominantly through weak inter-plane van der Waals forces, resulting in low shear strength between basal planes. Due to the strong bonding in-plane and the weak bonding out-of-plane, mechanical and other properties are highly anisotropic. In particular, the individual lamellae can easily slide against each other, enabling solid lubricity. See M. R. Vazirisereshk et al., *Lubricants* 7, 57 (2019).

Figure 2:
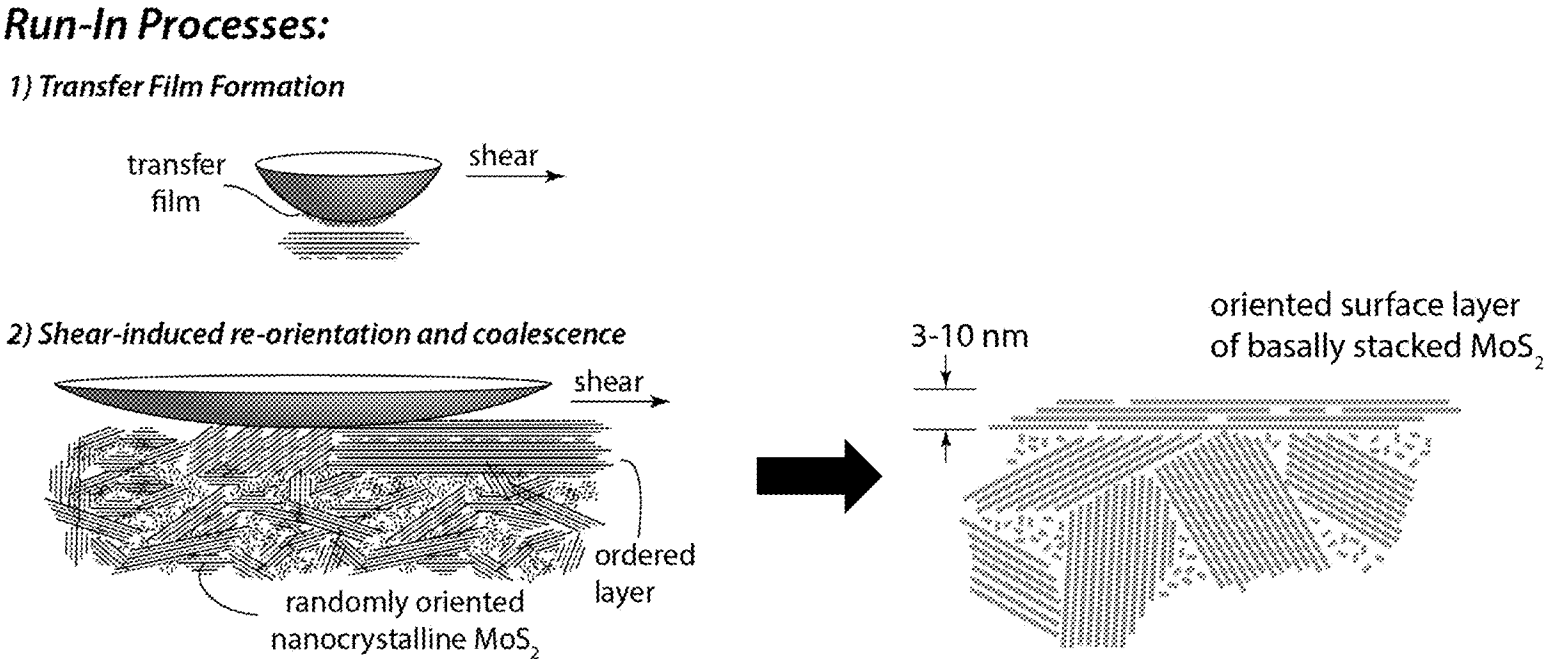
FIG. 2 is a schematic illustration of the run-in process.

A $MoS_2$ lubrication mechanism for sliding friction is shown in FIG. 2. Initially, a transfer film is formed on the counter-surface as it slides against the $MoS_2$ coating. The basal planes at the sliding interface (~10 nm thickness) of the $MoS_2$ coating gradually become re-oriented parallel to the sliding direction by shear. This run-in process thus aligns basal planes of the crystallites parallel to the substrate to allow for easy shear between lamellae on the surface of the coating and the transfer film formed on the counter surface. The formation of a basally oriented film with long range order is an important part of the run-in process and is frequently observed in initially nanocrystalline/amorphous physical vapor deposited (PVD) films. Therefore, shear-induced reorientation of the $MoS_2$ lamellae and the resulting easy shear sliding between the basal planes results in very low friction.

Figure 3:
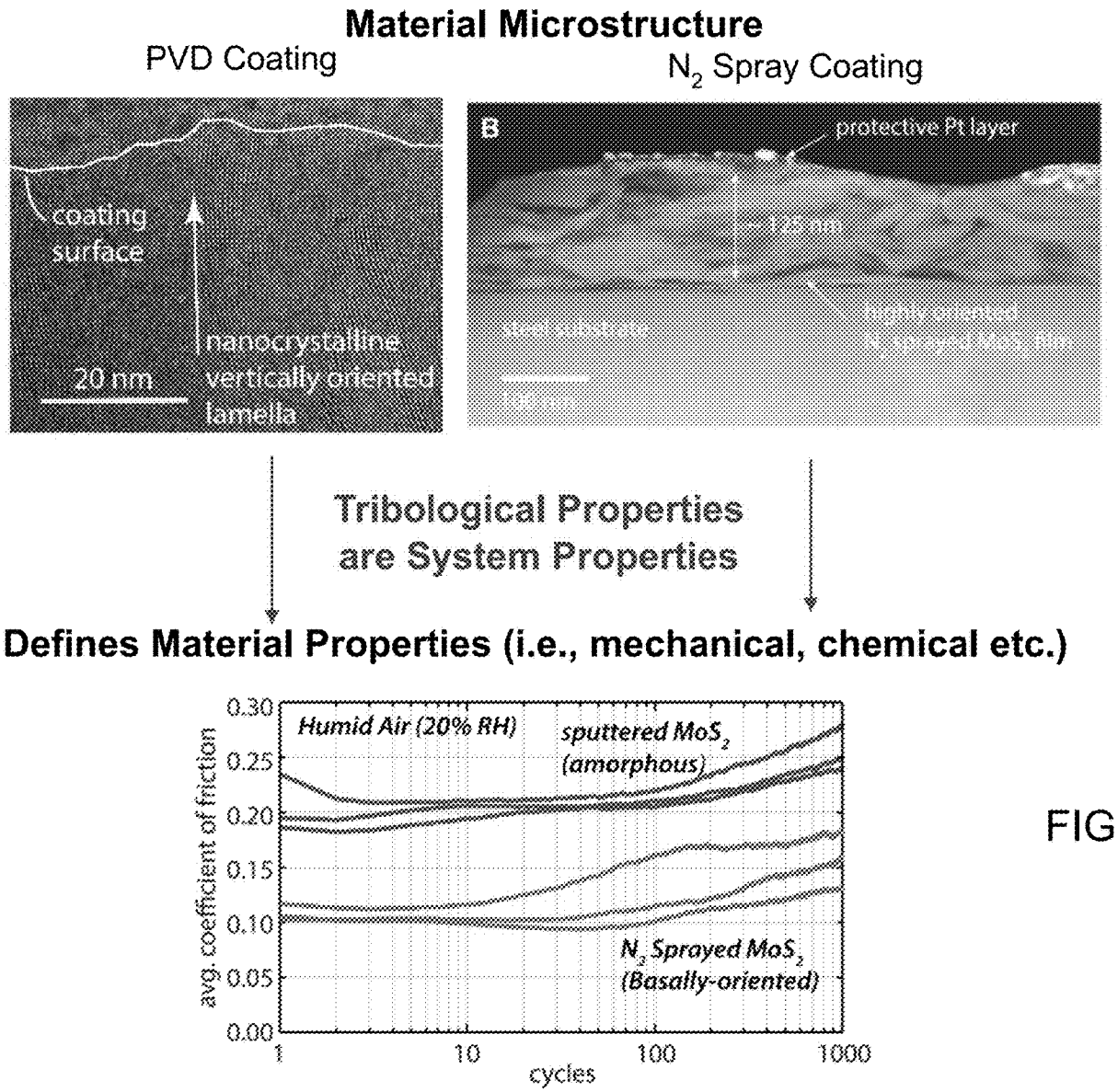
FIG. 3 shows the microstructure and run-in properties of amorphous and basally oriented crystalline $MoS_2$ films.
Figure 4B:
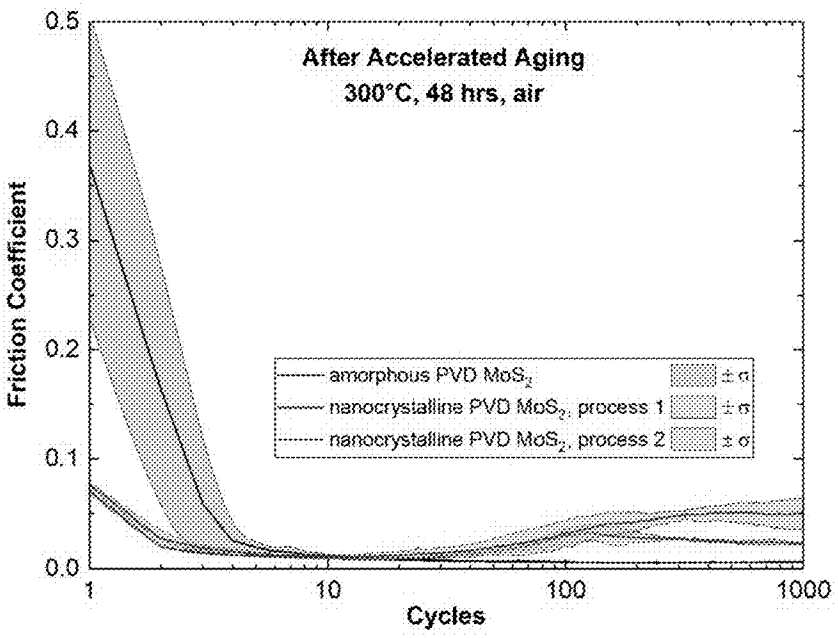
FIGS. 4A and 4B show the run-in properties of amorphous and nanocrystalline PVD $MoS_2$ films before (FIG. 4A) and after (FIG. 4B) accelerated aging to induce surface oxidation.
Figure 4A:
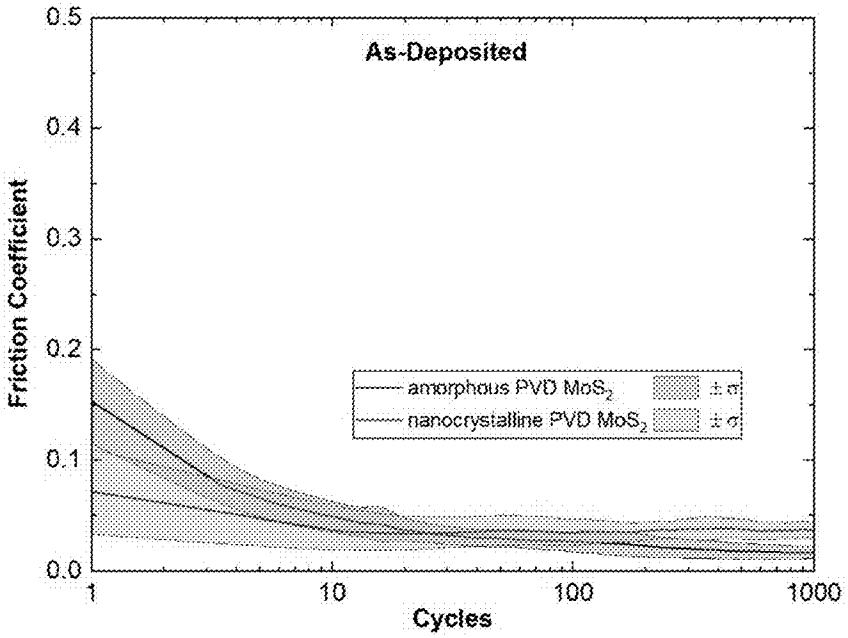

However, the tribological behavior of $MoS_2$ is extremely sensitive to environmental conditions, particularly to the presence of contaminants, such as oxygen, water, and hydrocarbons. Friction between $MoS_2$ lubricated surfaces has been shown to increase considerably with relative humidity and in the presence of molecular and atomic oxygen. High friction during run-in can cause operational problems in solid lubricated devices. Water and molecular oxygen tend to interrupt interactions between lamellae, preventing formation of the multi-layer, persistent basally oriented films with larger lamellae that are associated with low friction in $MoS_2$ lubricated contacts. Physical vapor deposition (PVD) processes, such as magnetron sputtering, can produce a variety of different morphologies and crystalline textures due to the large range of deposition parameters available. For example, magnetron-sputtered $MoS_2$ coatings can be produced in an amorphous, crystalline or nanocrystalline state. See J. Moser et al., *J. Phys D Appl. Phys.* 23, 624 (1990); and T. W. Scharf et al., *Acta Mater.* 58, 4100 (2010). Defects in PVD films provide pathways for oxygen to penetrate and find edge sites in $MoS_2$ that can react to form oxides throughout the depth. Further, it has been hypothesized that water inhibits the ability of amorphous $MoS_2$ films to form shear-induced, highly oriented tribofilms during sliding. See J. F. Curry et al., *Tribol. Lett.* 64, 11 (2016). Recently, studies have been conducted to compare the oxidation and friction of highly oriented $N_2$-spray-deposited $MoS_2$ films to amorphous films deposited by DC magnetron sputtering. See J. F. Curry et al., *Tribol. Lett.* 64, 11 (2016); J. F. Curry et al., *ACS Appl. Mater. Interfaces* 9, 28019 (2017); and J. F. Curry et al., *Tribol. Lett.* 69, 96 (2021). Highly ordered crystalline $MoS_2$ films exhibit higher resistance to oxidation compared to amorphous $MoS_2$ films. In particular, the large, basally-oriented films have very few edge sites and pathways for further reactivity with oxygen below the initial surface. Therefore, the highly oriented $MoS_2$ lamellae restrict the oxidation to the first few top layers, which can shorten the run-in period compared to amorphous $MoS_2$. Curry et al. found that the run-in coefficient of friction for highly oriented crystalline $MoS_2$ is low and the same under both dry and humid conditions, whereas the run-in behavior is highly environment dependent for amorphous films, as shown in FIG. 3. The dramatic differences in both run-in behavior and environmental sensitivities are attributed to the degree of initial crystallinity and orientation. Therefore, deposition techniques which result in highly oriented lamellae and a lower density of edge sites can reduce the amount of oxidation and sensitivity to humidity, thereby reducing the run-in time. This concept is illustrated in FIGS. 4A and 4B, which shows the evolution of friction behavior for both amorphous and nanocrystalline PVD coatings in the as-deposited condition and after accelerated aging at 300° C. to induce surface oxidation, respectively. Surface oxidation of the amorphous coating results in elevated friction coefficient for the first few cycles of operation, while the nanocrystalline coating exhibits starting friction coefficient that is barely changed from the as-deposited condition.

Figure 5:
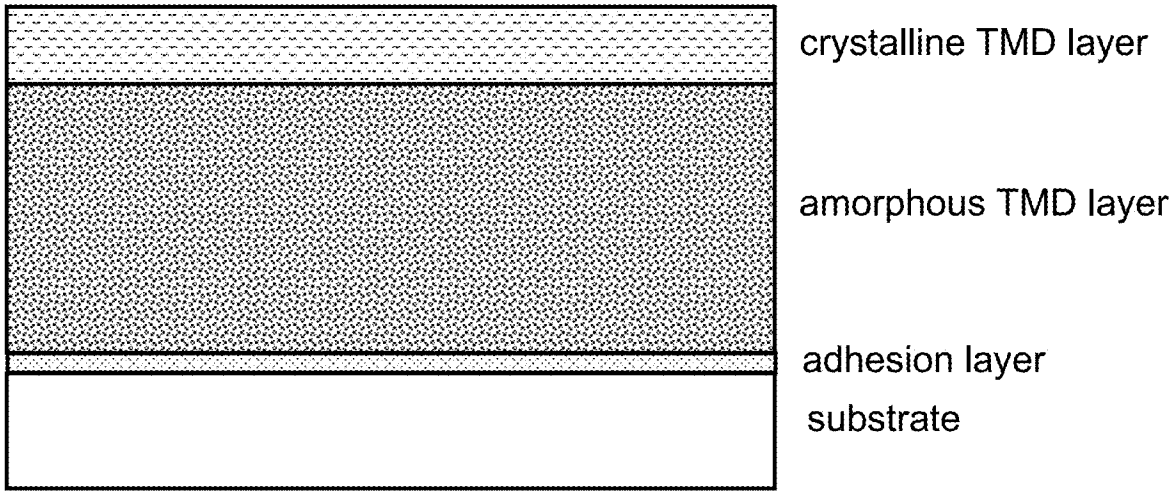
FIG. 5 is a schematic illustration of an exemplary environmentally stable solid lubricant coating comprising a bilayer of crystalline and amorphous TMD.

The present invention is directed to an environmentally stable solid lubricant coating, comprising an amorphous layer of a transition-metal dichalcogenide on a substrate; and a crystalline layer of the transition-metal dichalcogenide on top of the amorphous layer. As an example, a bilayer TMD film comprising a crystalline layer on top of an underlying amorphous layer is shown in FIG. 5. The bilayer structure can have large crystalline domains at the surface, which are more resistant to oxidation than amorphous films. Furthermore, if the crystals are oriented with the basal planes parallel to the surface, the oxidation resistance can be even higher. This orientation of crystallites also facilitates easy shear parallel to the surface, so can also produce reduced run-in compared to films without these bilayer structures. Therefore, a surface coating, with a thickness on the order of 100 nanometers or less, can be crystalline and ideally with basal planes parallel to the surface to resist oxidation and minimize the magnitude and duration of friction run-in. However, an initial basally oriented surface layer is not required. Any crystalline surface layer will have lower defect concentration compared to an amorphous surface, therefore providing fewer sites for adsorption and reaction with environmental species. The crystalline layer, regardless of orientation, will also exhibit low starting friction coefficient because very little energy is required to reorient the crystallites to a basal orientation during initial sliding. The amorphous bulk of the coating can create hard films that exhibit low wear rate and provide a reservoir of solid lubricant. The amorphous layer can be doped with metals or ceramics to further improve coating properties. The surface crystalline layer thereby provides an environmental barrier layer to protect the underlying amorphous layer from oxidation. The layers can be deposited by nitrogen spray deposition, physical vapor deposition, or atomic layer deposition.

Figure 6B:
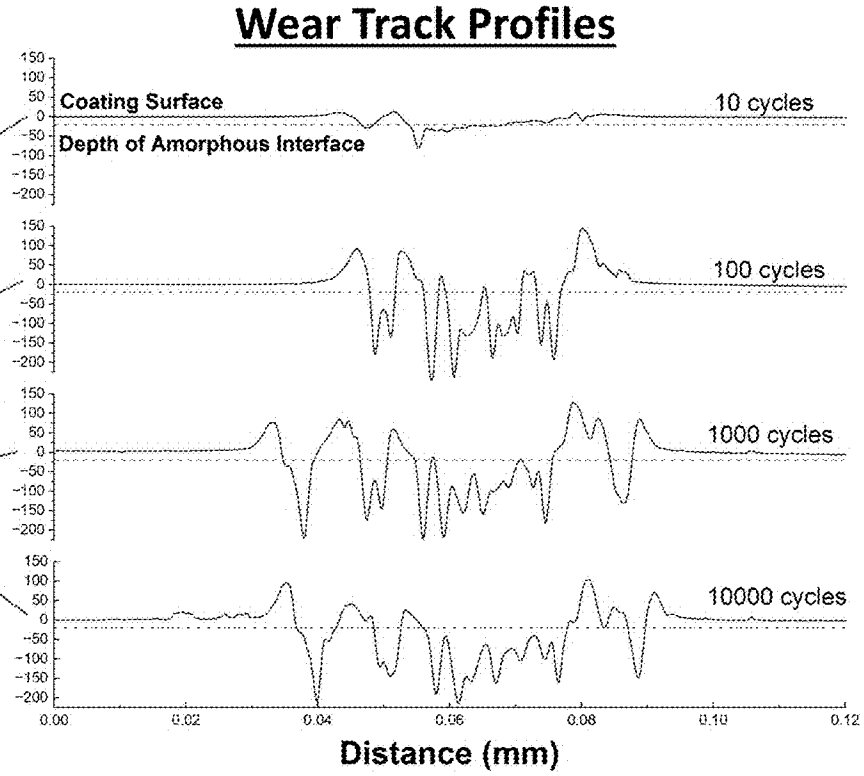
FIG. 6B shows the wear track profiles at 10, 100, 1000, and 10000 cycles.
Figure 6A:
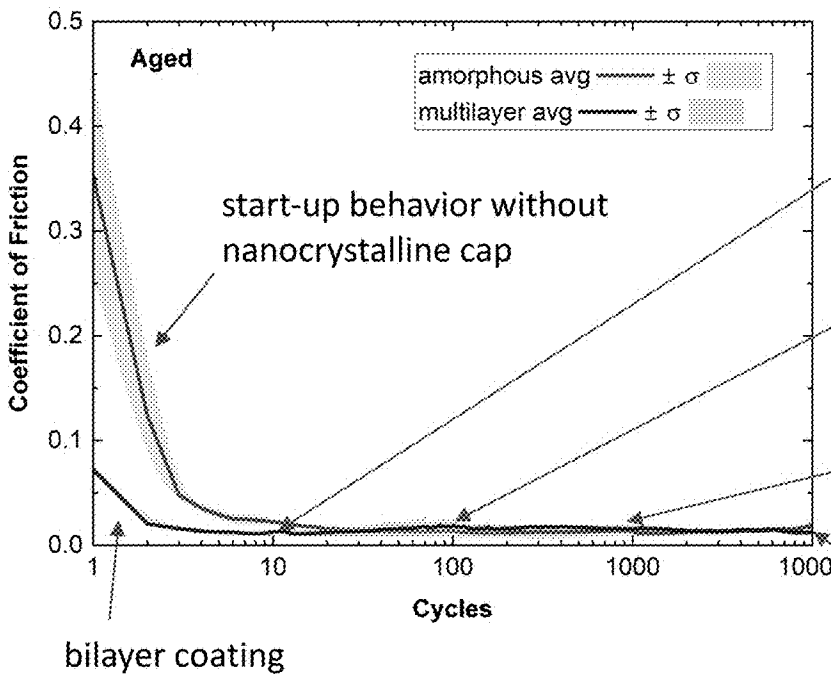
FIG. 6A is a graph showing the coefficient of friction as a function of sliding cycles for $MoS_2$ films with and without a nanocrystalline capping layer.

FIG. 6A is a graph showing the coefficient of friction as a function of sliding cycles and FIG. 6B shows the wear track profiles at 10, 100, 1000, and 10000 cycles for amorphous $MoS_2$ layers with and without a nanocrystalline capping layer. No increase in friction is observed for the bilayer film, even when the nanocrystalline surface layer is worn though over most of the track width after about 100 cycles. The nanocrystalline surface layer provides low starting friction and environmental stability, while stress-induced transformation of the basal layers below the sliding surface enables a smooth transition to low-wear bulk behavior.

Figure 7A:
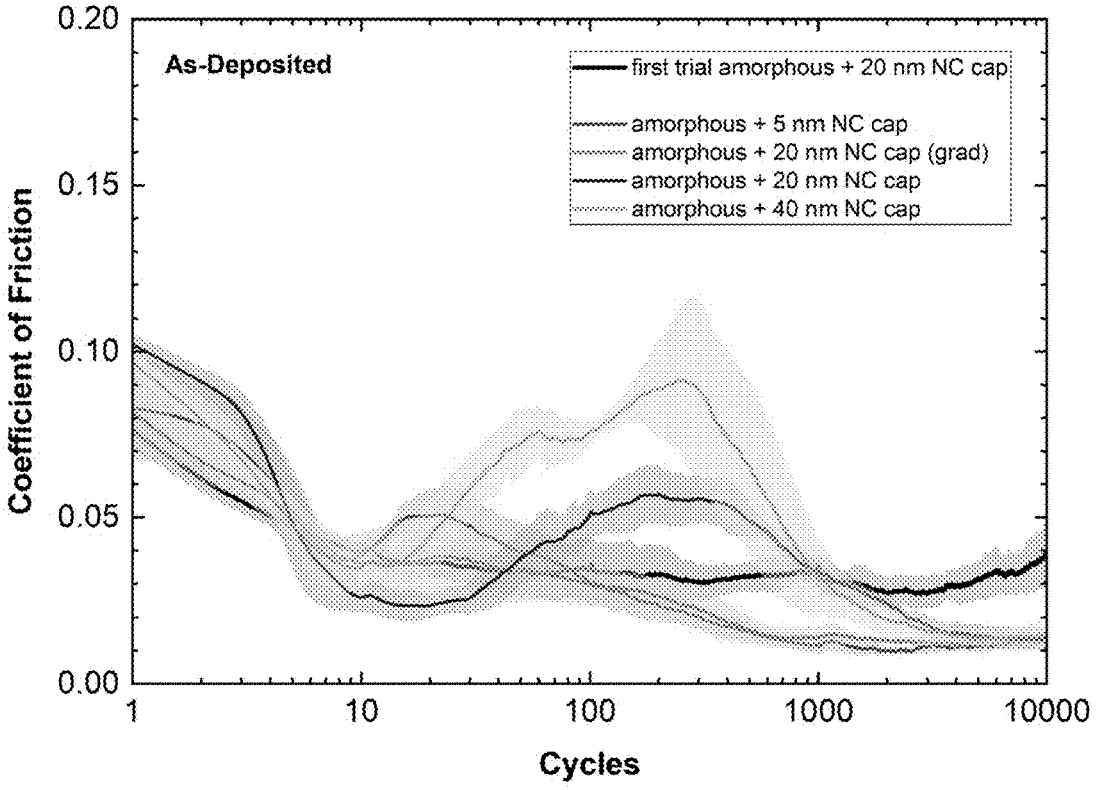
FIG. 7A is a graph showing the coefficient of friction for as-deposited bilayer coatings for a range of nanocrystalline surface layer thicknesses.
Figure 7B:
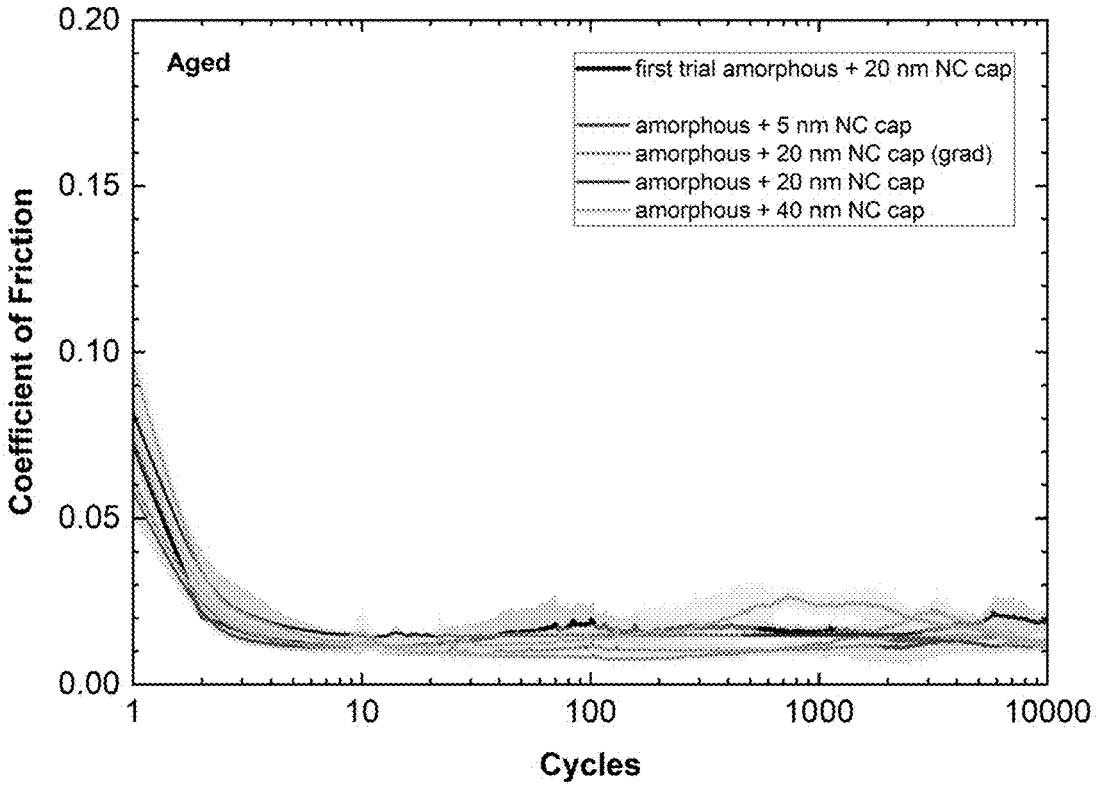
FIG. 7B shows similar data for aged bilayer coatings.

FIG. 7A shows the coefficient of friction for as-deposited bilayer coatings for a range of nanocrystalline surface layer thicknesses. FIG. 7B shows similar behavior for aged coatings. The bilayer coatings exhibit starting friction coefficient at or below 0.1, unchanged by aging. The unaged films exhibited slightly elevated friction at intermediate cycle durations (still below 0.1). The aged films exhibited steady-state friction coefficient even below that for as-deposited films.

The present invention has been described as an environmentally stable solid lubricant coating with oxidation and run-in resistance. It will be understood that the above description is merely illustrative of the applications of the principles of the present invention, the scope of which is to be determined by the claims viewed in light of the specification. Other variants and modifications of the invention will be apparent to those of skill in the art.

The invention claimed is:

1. A method for synthesizing environmentally stable bilayer solid lubricant coatings, comprising:

depositing an amorphous layer of a transition-metal dichalcogenide on a substrate; and depositing a crystalline layer of the transition-metal dichalcogenide on the amorphous layer.

2. The method of claim 1, wherein the transition-metal dichalcogenide comprises a transition metal atom, selected from the group consisting of molybdenum, tungsten, tantalum, and niobium, and two chalcogen atoms, selected from the group consisting of sulfur, selenium, and tellurium.

3. The method of claim 1, wherein the crystalline layer comprises randomly oriented crystallites.

4. The method of claim 1, wherein the crystalline layer comprises a basally oriented crystalline layer.

5. The method of claim 1, wherein the step of depositing the amorphous or crystalline layer comprises nitrogen spray deposition, physical vapor deposition, or atomic layer deposition.

6. An environmentally stable solid lubricant coating, comprising an amorphous layer of a transition-metal dichalcogenide on a substrate; and a crystalline layer of the transition-metal dichalcogenide on the amorphous layer.

7. The coating of claim 6, wherein the transition-metal dichalcogenide comprises a transition metal atom, selected from the group consisting of molybdenum, tungsten, tantalum, and niobium, and two chalcogen atoms, selected from the group consisting of sulfur, selenium, and tellurium.

8. The coating of claim 6, wherein the crystalline layer comprises randomly oriented crystallites.

9. The coating of claim 6, wherein the crystalline layer comprises a basally oriented crystalline layer.

10. The coating of claim 6, wherein the crystalline layer has a thickness of less than 100 nanometers.

* * * * *